United States Patent [19]

Flippin

[11] 4,277,898

[45] Jul. 14, 1981

[54] HYDRAULIC CONTROL SYSTEM FOR EXCAVATING MACHINE

[75] Inventor: James S. Flippin, Clearwater, Kans.

[73] Assignee: J. I. Case Company, Racine, Wis.

[21] Appl. No.: 106,794

[22] Filed: Dec. 26, 1979

[51] Int. Cl.[3] ..... A01B 67/00; E02F 5/06

[52] U.S. Cl. ..... 37/86; 37/DIG. 1; 172/3

[58] Field of Search ..... 37/DIG. 1, DIG.17, 86; 172/3, 7

[56] References Cited

U.S. PATENT DOCUMENTS

| | | | |
|---|---|---|---|
| 3,093,946 | 6/1963 | Pitt et al. | 37/DIG. 1 |
| 3,605,903 | 9/1971 | Glesmann | 37/86 X |
| 3,750,762 | 8/1973 | Eaton | 37/DIG. 17 |
| 4,023,622 | 5/1977 | Gregerson | 172/3 X |
| 4,192,088 | 3/1980 | Saalasti | 172/3 X |

*Primary Examiner*—Clifford D. Crowder

*Attorney, Agent, or Firm*—Cullen, Sloman, Cantor, Grauer, Scott & Rutherford

[57] ABSTRACT

A hydraulic control system is disclosed for a hydrostatically operated earth-working machine which automatically adjusts the travel speed of the machine in response to the load conditions being encountered by an attached powered implement. The system includes a control cylinder which is connected into the hydraulic circuit that powers the implement to sense changes in hydraulic pressure due to increased or decreased loads on the implement. Hydraulic pressure in the implement circuit extends the control cylinder piston when the implement is under load. An adjustable spring mechanism reacts against the rod end of the piston to keep the piston retracted in the cylinder when there is no load on the implement. A control link is pivotally mounted to the piston rod free end for selective connection to the ground drive control of the machine. The pivotal control link is only engageable with the ground drive control when the piston rod has been extended a pre-determined distance, which corresponds to optimum engine output, against the resistance of the spring mechanism. After the control link is locked into engagement with the ground drive control, pressure changes in the implement hydraulic circuit, due to increased or decreased load on the implement, cause corresponding linear back and forth movement of the piston rod which is transmitted by the control link to the ground drive control. This action automatically adjusts the ground speed of the mechanism in response to the load being encountered by the implement and thereby maintains a constant engine output.

1 Claim, 2 Drawing Figures

F'

FIG. 1
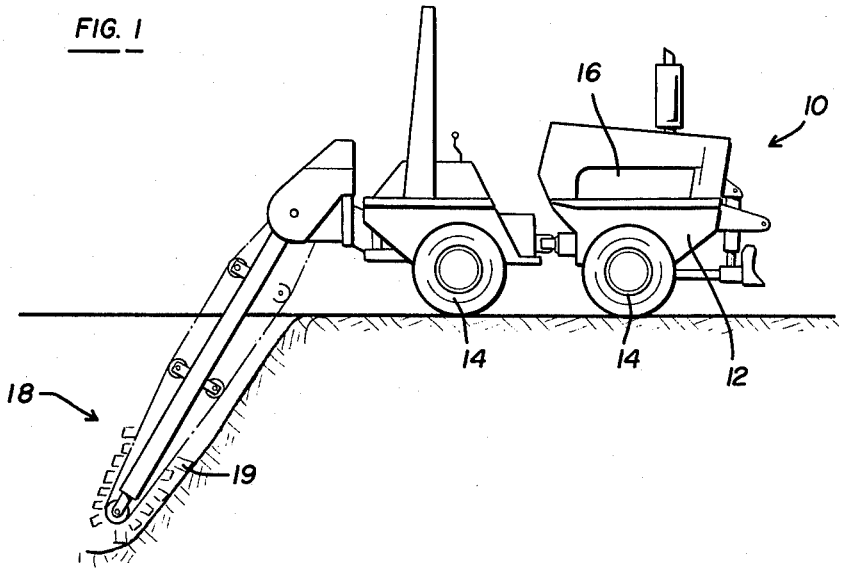
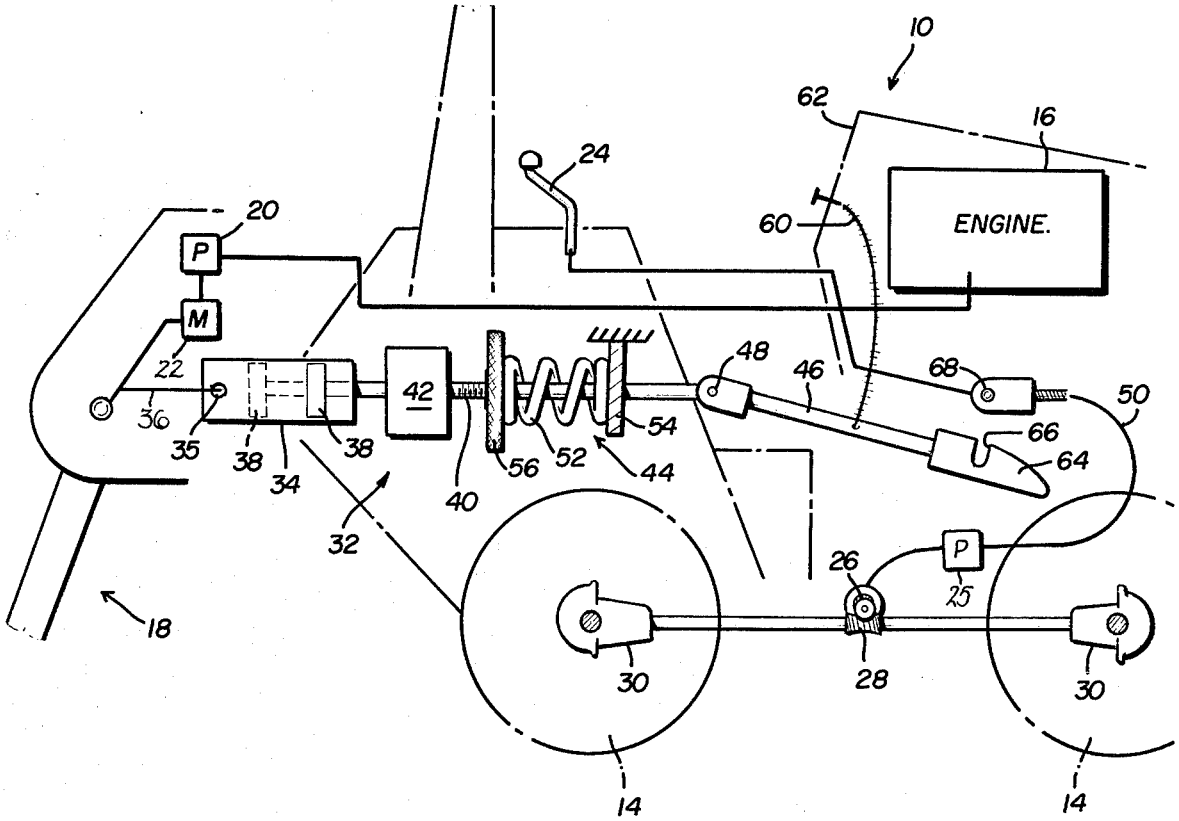
FIG. 2

HYDRAULIC CONTROL SYSTEM FOR EXCAVATING MACHINE

BACKGROUND OF THE INVENTION

The present invention relates to a hydraulic control system for automatically adjusting the travel speed of a machine to the work conditions being encountered by an attached powered implement. More particularly, the present invention relates to a tractor hydraulic system which is responsive to the load imposed on the tractor by a ground-engaging implement to control the ground speed of the tractor in accordance with such load.

It is conventional to provide a hydrostatically operated earth-working machine having separate hydraulic systems, one for powering the ground drive and another for powering the implement attachment. The operator manually adjusts the ground speed of the machine depending upon the load resistance being encountered by the implement. This manual correlation between ground speed and implement load is intended to maintain a constant load on the machine and thereby provide optimum engine efficiency.

A problem with known hydraulically operated tractor-implement systems is that the operator must constantly monitor the load conditions of the implement and simultaneously adjust the ground speed in response thereto. In practice, it is nearly impossible for the operator to maintain optimum engine efficiency and still perform the other operations required of him in running the machine.

For example, in a known hydrostatically operated trencher, a trenching boom is mounted to the tractor and one hydraulic system powers the digging chain on the boom while another hydraulic system controls ground speed, forward and reverse movement, turning, and braking. If the powered digging chain suddenly encounters a rocky soil condition, the operator must slow the tractor until the higher pressure developed in the trencher hydraulic circuit, due to the increased load, is reduced either by the trencher passing through the area or by some operator action. At the same time the operator is attempting to maintain maximum tractor engine efficiency, he must steer the unit and perform other normal running operations. Thus, there has been a need for a hydraulic control system which automatically adjusts the travel speed of the tractor in response to the work conditions being encountered by the attached powered implement.

Conventional manual controls for correlating tractor ground speed with implement load conditions are ineffective in maintaining high engine efficiency because it is not always possible for the operator to give his undivided attention to monitoring the implement load and ground speed variables. Thus, the disadvantages of the present hydrostatically operated earth working machines have resulted in the hydraulic control system of the present invention which effectively reduces required operator participation and results in greater output because the tractor engine operates substantially at optimum efficiency.

SUMMARY OF THE INVENTION

In accordance with the present invention, a hydraulic control system is provided for hydrostatically operated earth-working machines which automatically adjusts the travel speed of the tractor in response to the work conditions being encountered by an attached powered implement.

The present hydraulic control system is disclosed for use in a hydrostatically operated trencher, but it may be utilized in any earth-working machine where it is desirable to control the ground speed of the tractor in accordance with the load imposed on the ground-engaging implement.

The present invention includes a control cylinder which is connected into the operating (i.e., high pressure) side of the hydraulic circuit that powers the digging chain on the trencher boom. The cylinder is connected to the circuit at its piston end so that hydraulic pressure in the circuit is translated into a linear force on the piston to extend it when the digging chain is working and under load. The piston rod is elongated to pass through a mass dampener and also through an adjustable coil spring mechanism, both of which are outside the cylinder housing. A control link is pivotally mounted to the piston rod free end for selective connection to the ground drive control of the machine when optimum engine output is reached.

The adjustable spring mechanism reacts against the rod end of the piston to keep the piston retracted in the cylinder when there is no pressure in the trencher circuit (i.e. no work is being done by the digging chain). The piston rod passes through the coil spring mechanism and is linearly movable therein. One end of the coil spring is fixed by a mounting plate connected to the tractor frame, and the other end of the spring bears against an adjustable disk which is threadedly mounted to the piston rod. Increased hydraulic pressure in the trencher circuit, when the digging chain is under load, causes the piston rod to extend, but the extension of the piston rod is opposed by the compression of the coil spring mechanism. Thus, the piston is shifted linearly back and forth in response to the counter-reactive forces caused by the hydraulic pressure in the trencher circuit and the spring mechanism.

Another function of the spring mechanism as well as the mass dampener is to reduce hunting or other undesirable oscillations which typically occur in a control system such as provided by the present invention.

The pivotal control link mounted to the free end of the piston rod is only engageable with the ground drive control when the piston rod has been extended a predetermined distance against the resistance of the spring mechanism. The pre-determined extension distance corresponds to the optimum engine output, and it will vary depending on the engine being used in the machine. When this "equilibrium" or "optimum" point is reached, the operator pulls on a push-pull cable mechanism connected between the operator's console and the pivotal control link to pull the control link into locking engagement with the cable control for the ground drive hydraulic pump.

Thereafter, changes in the trencher circuit pressure, due to increased or decreased load on the digging chain, cause corresponding linear back and forth movement of the piston rod which is extended by hydraulic pressure increases in the trencher circuit and retracted by the spring mechanism when the hydraulic pressure decreases. This back and forth shifting movement of the piston rod is transmitted by the engaged control link to the ground drive control cable which strokes or destrokes the ground drive pump. This action automatically adjusts the ground speed of the machine in response to the load being encountered and thereby maintains a constant engine output.

The present hydraulic control system operates as follows. When there is no load on the digging chain, and consequently no pressure in the trencher circuit, the spring mechanism maintains the control cylinder piston in its retracted position. As the pressure in the trencher circuit increases, either because the operator increases the ground speed or the digging chain is under load, the piston extends thereby compressing the coil spring. When the piston rod is extended a pre-determined distance determined by the engine output, the operator may pull the pivotal control link on the piston rod into locking engagement with the ground drive pump control cable at which point the system becomes automatically controlled. A reduction in system pressure (i.e. less load on the digging chain) permits the coil spring to expand which causes the pump to be stroked thereby increasing the machine ground speed. An increase in pressure (i.e. more load on the digging chain) causes the ground pump to be destroked thereby decreasing the machine ground speed. Thus, the present invention automatically adjusts the machine travel speed in response to the load on the powered implement.

Other advantages and meritorious features of the hydraulic control system of the present invention will be more fully understood from the following description of the preferred embodiment, the appended claims, and the drawings, a brief description of which follows.

BRIEF DESCRIPTION OF DRAWINGS

FIG. 1 is a side elevational view of an earth-working machine embodying the hydraulic control system of the present invention.

FIG. 2 is a schematic illustration of the hydraulic control system of the present invention.

DESCRIPTION OF THE PREFERRED EMBODIMENT

A preferred embodiment of an earth-working machine including the hydraulic control system made in accordance with the teachings of the present invention is illustrated in FIGS. 1–2.

The hydrostatically operated trenching machine 10 shown in FIG. 1 is seen to include a tractor main frame 12, ground engaging wheels 14, and an engine 16. A trenching boom 18 is pivotally mounted on the rear of the tractor main frame 12 and a digging chain 19 is rotatably mounted to the trenching boom for digging in soil. Further details of the construction of the trencher 10 are unnecessary since they form no part of the present invention.

Trencher 10 includes separate hydraulic systems, as is conventional, one for powering the ground engaging wheels 14 and another for powering the trencher implement attachment 18. The trencher digging chain drive circuit is schematically illustrated in FIG. 2, and it includes engine driven pump 20 and hydraulic motor 22 which are operatively connected between the trencher 18 and engine 16, as is conventional. The ground drive circuit is also schematically illustrated in FIG. 2, and it includes single lever control 24, ground drive or propulsion pump 25, hydraulic motor 26, gearing 28, and differential-axle assemblies 30. The ground drive hydraulic circuit controls ground speed, forward and reverse movement, turning and braking. The trencher digging chain drive circuit and ground drive circuit are conventional hydraulic circuits and by themselves form no part of the present invention.

The present invention relates to a hydraulic control system 32 for automatically adjusting the travel speed of trencher 10 in response to the work or load conditions being encountered by digging chain 19. Hydraulic control system 32 is disclosed for use in trencher 10, but it may be utilized in any earth-working machine where it is desirable to control the ground speed of the tractor in accordance with the load imposed on the ground-engaging implement.

The hydraulic control system 32 includes a control cylinder 34 which is connected into the operating (i.e., high pressure) side of the hydraulic circuit 20, 22 that powers the digging chain 19 on the trencher boom. The cylinder 34 is hydraulically connected to the circuit at its piston end 35 by conduit 36 so that hydraulic pressure in the digging chain circuit is translated into a linear force on the piston 38 to extend it when the digging chain is working and under load. Piston 38 includes piston rod 40 which is elongated to pass through a mass dampener 42 and also through an adjustable coil spring mechanism 44, both of which are outside the cylinder housing 34. A control link 46 is pivotally mounted to the piston rod free end by pivot pin 48 for selective connection to the ground drive control 50 of the machine when optimum engine output is reached.

The adjustable spring mechanism 44 reacts against the rod end of the piston 38 to keep the piston retracted in the cylinder 34 when there is no pressure in the trencher circuit (i.e. no load on the digging chain). The piston rod 40 passes through the coil spring mechanism 44 and is linearly movable therein. One end of the coil spring 52 is fixed by a mounting plate 54 to the tractor frame 12, and the other end of the spring 52 bears against an adjustable disk 56 which is threadedly mounted to the piston rod 40. Increased hydraulic pressure in the trencher circuit, when the digging chain 19 is under load, causes the piston rod 40 to extend, but the extension of the piston rod is opposed by the compression of the coil spring 52. Thus, piston 38 is shifted linearly back and forth in response to the counter-reactive forces caused by the changing hydraulic pressure in the trencher circuit 20, 22 and by the spring mechanism 52.

Another function of the spring mechanism 44 as well as the mass dampener 42 is to reduce hunting or other undesirable oscillations which typically occur in a control system such as provided by the present invention.

The pivotal control link 46, mounted to the free end of the piston rod 40, is only engageable with the ground drive control 50 when the piston rod 40 has been extended a pre-determined distance against the resistance of coil spring 52. The pre-determined extension distance corresponds to the optimum engine output, and it will vary depending on the engine being used in the machine. When this "optimum" point is reached, the operator pulls on push-pull cable mechanism 60 connected between the operator's console 62 and the pivotal control link 46 to pull the control link 46 into locking engagement with the cable control 50 for the ground drive hydraulic pump 25. When locked, pin 68 on the end of cable control 50, fits within recess 66 of control link extension 64.

Thereafter, changes in the trencher circuit pressure, due to increased or decreased load on the digging chain, causes corresponding linear back and forth movement of the piston rod 40, which is extended by the hydraulic pressure increases in the trencher circuit 20, 22 and retracted by the coil spring 52 when the hydraulic pressure decreases. This back and forth shifting movement of the piston rod 40 is transmitted by the engaged control link 46 to the ground drive control cable 50 which strokes or destrokes the ground drive pump 25. This action automatically adjusts the ground speed of the machine in response to the load being encountered and thereby maintains a constant engine output.

The present hydraulic control system 32 operates as follows. When there is no load on the digging chain 19, and therefore no pressure in the trencher circuit 20, 22, the spring mechanism 44 maintains the control cylinder piston 38 in its retracted position. As the pressure in the trencher circuit increases, either because the operator increases the ground speed of the machine or because the digging chain 19 is under load, the piston rod 40 extends thereby compressing the coil spring 52. When the piston rod 40 is extended a pre-determined distance, determined by the engine output, the operator may pull the pivotal control lever 46 on the piston rod 40 into locking engagement with the ground drive pump control cable 50, at which point, the system becomes automatically controlled. A reduction in system pressure (i.e. less load on the digging chain) permits the coil spring 52 to expand which causes the pump 25 to be stroked thereby increasing the machine ground speed. An increase in pressure (i.e. more load on the digging chain) causes the ground pump 25 to be destroked thereby decreasing the machine ground speed. Thus, the present invention automatically adjusts the machine travel speed in response to the load on the powered implement.

Fine tuning of the hydraulic control system is accomplished by adjusting disk 56 on the threaded portion of piston rod 40. This fine adjustment can be used to compensate for fuel changes or other changes in the system which affect the pre-determined extension distance for maximum engine output.

It will be apparent to those skilled in the art that the foregoing disclosure is exemplary in nature rather than limiting, the invention being limited only by the appended claims.

I claim:

1. In a hydrostatically operated earth-working machine having separate hydraulic circuits, one of said hydraulic circuits powering a ground drive system for said machine and another hydraulic circuit powering an earth-working implement which is attached to said machine, the improvement comprising:

a hydraulic control system for automatically adjusting the travel speed of said machine in response to load conditions encountered by said attached earth-working implement, said hydraulic control system including a control piston-cylinder which is mounted to said machine, said control piston-cylinder being hydraulically connected to said implement hydraulic circuit at its piston end, said piston including an elongated piston rod;

an adjustable spring mechanism being mounted to said machine outside said control cylinder, said elongated piston rod passing through said spring mechanism and being linearly movable therein, said spring mechanism including a coil spring, said piston rod passing through said coil spring and being linearly movable therein, one end of said coil spring being fixed to said machine and the other end of said spring bearing against an adjustable disk which is threadedly mounted to said piston rod;

a control link pivotally mounted to the end of said piston rod opposite said piston;

cable control means mounted to said machine, one end of said cable control means being connected to a ground drive hydraulic pump and the other end of said cable control means being mounted to said machine adjacent said pivotal control link, said ground drive pump being hydraulically connected to said ground drive circuit;

said spring mechanism being connected to said piston rod and reacting against said piston to keep said piston retracted when there is no pressure in said implement hydraulic circuit, the presence of pressure in said implement circuit causing said piston to extend against the resistance of said spring mechanism;

said piston being extendable a pre-determined distance due to increased hydraulic pressure in said implement circuit when said earth-working implement is under load, means for selectively locking said control link into an engaged position with said cable control means when said piston has been extended said pre-determined distance; and changes in pressure in the implement hydraulic circuit due to increased and decreased load on said implement causing corresponding linear shifting movement of said piston, said shifting movement of said piston being transmitted by said control link in its engaged position to said ground control pump for automatically adjusting the travel speed of said machine in response to the load being encountered by said implement.

* * * * *